United States Patent [19]

Fukase et al.

[11] Patent Number: 4,957,842

[45] Date of Patent: Sep. 18, 1990

[54] LIQUID DEVELOPER FOR ELECTROSTATIC LATENT IMAGES USING FLUSHED PIGMENTS

[75] Inventors: Toshiyuki Fukase, Numazu; Yoshihiro Sugiyama, Mishima; Hazime Takanashi, Numazu; Kazuo Tsubuko, Numazu; Shinichi Kuramoto, Numazu, all of Japan

[73] Assignee: Ricoh Co., Ltd., Tokyo, Japan

[21] Appl. No.: 922,235

[22] Filed: Oct. 23, 1986

[30] Foreign Application Priority Data

Oct. 30, 1985 [JP] Japan ..... 60-243495

[51] Int. Cl.[5] ..... G03G 9/12

[52] U.S. Cl. ..... 430/114

[58] Field of Search ..... 430/114

[56] References Cited

U.S. PATENT DOCUMENTS 3,547,822 12/1970 Miller ..... 430/106.6

3,657,130 4/1972 Machida et al. ..... 430/114 X 4,794,066 12/1988 Taggi et al. ..... 430/137

*Primary Examiner*—J. David Welsh

*Attorney, Agent, or Firm*—Flynn, Thiel, Boutell & Tanis

[57] ABSTRACT

The present invention relates to a liquid developer for electrostatic latent images which comprises a toner comprising a colorant and a binding agent as the main components dispersed in an aliphatic hydrocarbon carrier liquid, characterized in that said colorant is prepared by using a yellow dye or pigment having the following general formula (I),

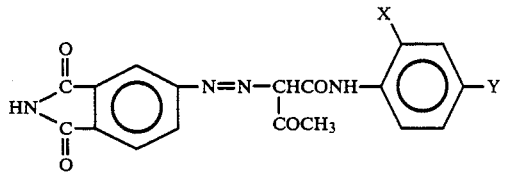

(I)

(wherein X and Y represent —H, —$OCH_3$, —Cl, —$CH_3$, —$CH_2CH_3$, —$CH_2CH_2CH_3$, —$OCH_2CH_3$, —$CH_2CH_2CH_2CH_3$ or —$OCH_2CH_2CH_3$).

11 Claims, No Drawings

LIQUID DEVELOPER FOR ELECTROSTATIC LATENT IMAGES USING FLUSHED PIGMENTS

BACKGROUND OF THE INVENTION (a) Field of the Invention

This invention relates to a liquid developer for electrostatic latent images, in particular relates to a liquid developer for electrophotography which contains a specific dye or pigment as a colorant.

(b) Description of the Prior Art

It is known to produce a color copy by separating the color of an original into the three primary colors to produce electrostatic latent images for each of the three primary colors, developing said electrostatic latent images with each color liquid developer of cyan, magenta and yellow colors, and transferring the developed each color on a single transfer sheet. A good transparency is required for the toner of this type of color developer. When the transparency of the toner is poor, the color of an original is not accurately reproduced on a color copy, and when the copy thus developed with such toner is applied to an overhead projector, the projected image becomes blackish.

It is further required for the toner of a liquid developer to have a stable electric charge for a long time and a stable dispersibility. The above mentioned stability is gradually lost mainly because a colorant is gradually dissolved in an aliphatic hydrocarbon carrier liquid thereby to deteriorate the properties of the carrier liquid and toner.

However, none of the yellow type colorants conventionally used for a yellow liquid developer could satisfy the above mentioned two properties.

SUMMARY OF THE INVENTION

The primary object of the present invention is to provide a liquid developer for electrostatic latent images containing a toner superior in transparency and retaining stable properties in an aliphatic hydrocarbon carrier liquid for a long time.

The secondary object of the present invention is to provide a liquid developer for electrostatic latent images, which is superior in the gradation reproducibility, dryness and transparency, and in particular which is capable of displaying a superior color reproducibility when used with a color copier or an overhead projector.

That is, an object of the present invention is to provide a liquid developer for electrostatic latent images which comprises a toner comprising a colorant and a binding agent as the main components dispersed in an aliphatic hydrocarbon carrier liquid, characterized in that said colorant is prepared by using a yellow dye or pigment having the following general formula (I),

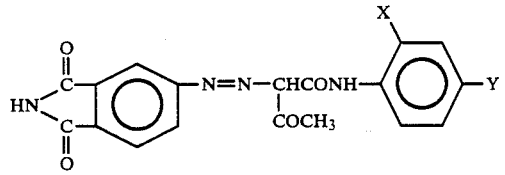

(wherein X and Y represent —H, —$OCH_a$, —Cl, —$CH_3$, —$CH_2CH_3$, —$CH_2CH_2CH_3$, —$OCH_2CH_3$, —$CH_2CH_2CH_2CH_3$ or —$OCH_2CH_2CH_3$).

DETAILED DESCRIPTION OF THE INVENTION

The color liquid developer of the present invention comprises a toner comprising a colorant and a binding agent as the main components dispersed in an aliphatic hydrocarbon carrier liquid, characterized in that said colorant is prepared by using a yellow dye or pigment having the following general formula (I),

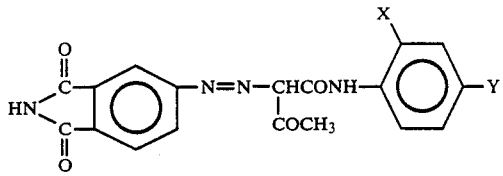

(wherein X and Y represent —H, —$OCH_3$, —Cl, —$CH_3$, —$CH_2CH_3$, —$CH_2CH_2CH_3$, —$OCH_2CH_3$, —$CH_2CH_2CH_2CH_3$ or —$OCH_2CH_2CH_3$).

The above colorant may be used in combination with publicly known blue or red dyes or pigments which are superior in transparency and insoluble in a carrier liquid, thus producing a green or orange color developer.

It is preferable for the developer of the present invention to use a colorant prepared by subjecting the above mentioned dyes or pigments to flushing treatment with a resin insoluble in a carrier liquid and having a softening point of 50°~120° C. in order to further improve transparency.

Up to now, it has been considered to prepare a colorant for toner by subjecting an inorganic or organic pigment such as carbon black, phthalocyanine blue or the like to flushing treatment.

However, when a resin soluble in a carrier liquid is employed as a resin for use in flushing treatment, since said resin is soluble in the carrier liquid used for dispersing a toner, some kinds of resins are liable to deteriorate the electric resistance of the carrier liquid or to make the polarity of toner particles unstable. The polarity is sometimes reversed. Consequently, a clear-cut image can not be formed because the image density is lowered and its background is stained. In view of this, it is customary to use a resin insoluble or hardly soluble in the carrier liquid as a resin for colorant. In the past, however, the following defects have been observed that the sedimentation, aggregation or the like of the toner is caused in a developer, thereby deteriorating the dispersion stability of the toner, and the resultant copy is insufficient in dryness and is short of primary fixativity which brings the undesirable phenomena such as off-set and the like unless consideration is given for prescribing a pigment and a resin so that compatibility is balanced therebetween at the time of preparing a colorant or unless some step is adopted for taking much time in dispersion at the time of preparing a toner.

As described above, it is preferable for the liquid developer of the present invention to subject a pigment or dye represented by said general formula (I) to flushing treatment, and to use the thus treated pigment or dye as a toner component. Explanation will be made on "flushing treatment" hereinafter.

In the flushing treatment, an aqueous paste of a pigment or dye is put in a kneader called as a flusher together with a resin or resin solution, and is fully mixed. In the course of this process, water present around the pigment is replaced with the resin solution. The resultant water phase is taken out of the kneader. The remaining material having the pigment or dye dispersed in the resin solution is dried to remove the solvent therefrom. Thereafter, the resultant massive material is ground. The material thus ground is referred to as a "flushing-treated colorant". In this instance, it is possible to adopt the measure of removing water and solvent under reduced pressure while blending in the kneader.

The flushing treatment is known to obtain a very superior dispersion because an aqueous paste can be used as raw material and said raw material can be treated while blending in the kneader. In the flushing treatment, furthermore, substantially the same effect as achieved by the use of a pigment can be achieved by the use of a dye together with water. Accordingly, the present invention makes it possible to employ the dye to be flushing-treated as the toner component.

Typical examples of dyes and pigments used in the present invention include as follows:

(1) Pigment Yellow 167 (C.I. No. 10737)

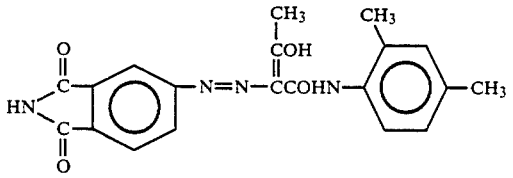

(2)
N-[2-(isoindoline-1,3-dione-5-ylazo)acetoacetyl]amino-benzene

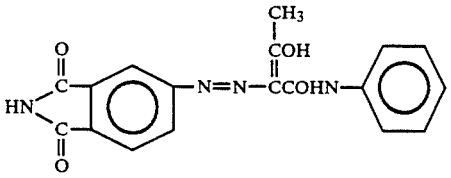

(3)
N-[2-(isoindoline-1,3-dione-5-ylazo)acetoacetyl]1-amino-2,4-diethylbenzene

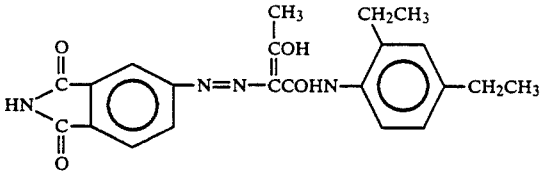

(4)
N-[2-(isoindoline-1,3-dione-5-ylazo)acetoacetyl]1-amino-4-methylbenzene

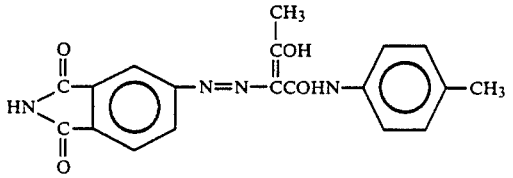

(5)
N-[2-(isoindoline-1,3-dione-5-ylazo)acetoacetyl]1-amino-2,4-dimethoxybenzene

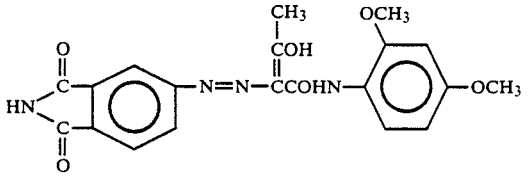

Examples of resins and waxes used in subjecting these dyes or pigments to flushing treatment include polyethylene wax, polyethylene oxide wax, modified polyethylene wax and the like, examples of commericially available products of which include as follows:

| Maker | Trade Name | Softening Point (°C.) |
|---|---|---|
| Eastman Chemical | N-10 | 111 |
| | N-11 | 108 |
| | N-12 | 113 |
| | N-14 | 106 |
| | N-34 | 103 |
| | N-45 | 118 |
| | C-10 | 104 |
| | C-13 | 110 |
| | C-15 | 102 |
| | C-16 | 106 |
| | E-10 | 106 |
| | E-11 | 106 |
| | E-12 | 112 |
| | E-14 | 104 |
| | E-15 | 100 |
| Mitsui Sekiyu Kagaku | 110P | 100 |
| | 220P | 113 |
| | 220MP | 113 |
| | 320MP | 114 |
| | 210MP | 120 |
| | 4202E | 108 |
| | 4053E | 111 |
| BASF | OA wax | 93~96 |
| Petrolite | BARECO 500 | 86 |
| | BARECO 655 | 102 |
| | BARECO 1000 | 113 |
| | E 730 | 93 |
| | E 2018 | 117 |
| | E 2020 | 117 |
| | E 1040 | 105 |
| | PETRONABA C | 90.5 |
| | PETRONABA C-36 | 90.5 |
| | PETRONABA C-400 | 104.5 |
| | PETRONABA C-7500 | 97.8 |
| Hoechst | PE520 | 118~120 |
| | PED121 | 113~118 |
| | PED136 | 107~112 |
| | PED153 | 115~120 |
| | PED521 | 103~108 |
| | PED522 | 100~105 |
| | PED534 | 98~105 |
| Allied Chemical Corp. | AC-polyethylene 6 & 6A | 102 |
| | AC-polyethylene 615 | 105 |
| | AC-polyethylene 1702 | 98 |
| | AC-polyethylene 430 | 60 |
| | AC-polyethylene 405 | 95 |
| | AC-polyethylene 401 | 102 |
| | AC-polyethylene 540 | 108 |
| | AC-polyethylene 580 | 108 |
| Sanyo Kasei | Sun Wax 131-P | 108 |
| | Sun Wax 151-P | 107 |
| | Sun Wax 161-P | 111 |
| | Sun Wax 165-P | 107 |
| | Sun Wax 171-P | 105 |
| Union Carbide | DYNI | 102 |
| | DYNF | 102 |
| | DYNH | 102 |
| | DYNJ | 102 |

-continued

| Maker | Trade Name | Softening Point (°C.) |
|---|---|---|
| | DYNK | 102 |
| Monsanto | ORLIZON 805 | 116 |
| | ORLIZON 705 | 116 |
| Phillips | MARLEX 1005 | 92 |
| Du Pont | ALATHON 3 | 103 |
| | ALATHON 10 | 96 |
| | ALATHON 12 | 84 |
| | ALATHON 14 | 80 |
| | ALATHON 16 | 95 |
| | ALATHON 20 | 86 |
| | ALATHON 22 | 84 |
| | ALATHON 25 | 96 |

In addition thereto, as polyethylene resins, there can be enumerated Sun Wax E200 (manufactured by Sanyo Kasei K.K.), 2000, 2500, 3000, 4000, 4100, 8000B, 5000, 6000 and 7000 (manufactured by Chubu Polyethylene K.K.). As polypropylene resins, there can be enumerated Biscoal 500P and 660P (manufactured by Sanyo Kasei K.K.). As vinyl chloride resin, there can be enumerated Denka Vinyl SS-100, SS-130, DSS-130, SS-140, SS-80, SS-70, SS-Y, SH-250, SH-170, M-70, M-120, MM-90, EM-140, VP-30, SE-130, ME-120, ME-180, MHE-100, PA-100 and P-80 (manufactured by Denki Kagaku Kogyo K.K.). In addition, paraffin wax (softening point: 50°~98° C.), bees wax (softening point: about 60° C.), natural wax (softening point: about 51° C.) and the like can also be used.

The above mentioned resin or wax is used in an amount of 0.1~6.0 parts by weight, preferably 0.1~0.6 part by weight per 1 part by weight of dye or pigment in the flushing treatment.

The preparation of a liquid developer using the "flushing-treated colorant" thus obtained is carried out by (i) mixing the colorant and a binding agent with a small amount of carrier liquid, (ii) kneading and dispersing the resultant mixture in an attritor, ball mill, KD-mill or the like to produce a concentrated toner, and (iii) diluting the concentrated toner about 5~10 times with the same type of carrier liquid as used above depending on the use. A preferable weight ratio of colorant/binding agent is 1/1~10.

Examples of a binding agent used herein include alkyd resin, rosin-modified phenol formaldehyde resin, hydrogenated rosin-polyhydric alcohol ester, polyacryl or polymethacryl ester resin, styrene resin, chlorinated rubber, and the like.

Above all, however, there are effectively used homopolymers or copolymers of a monomer represented by the following general formula (II),

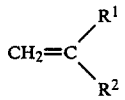

(II)

wherein $R^1$ represents hydrogen or methyl group, and $R^2$ represents $—COOC_mH_{2m+1}$ or $—OCOC_mH_{2m+1}$ (m is an integer of 6~20).

The above monomer of the formula (II) may be copolymerized with at least one monomer selected from the group consisting of acrylic acid, methacrylic acid, vinyl pyridine, ethylene glycol dimethacrylate, a monomer expressed by the following general formula (III),

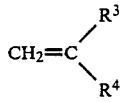

(III)

[wherein $R^3$ represents hydrogen or methyl group, and $R^4$ represents $—COOC_mH_{2m+1}$ or $—OCOC_mH_{2m+1}$ (m is an integer of 1~5] and a monomer expressed by the following general formula (IV),

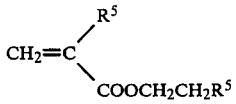

(IV)

[wherein $R^5$ represents hydrogen or methyl group, and $R^6$ represents $—N(CH_3)_2$, $—N(C_2H_5)_2$ or —OH]. The copolymer may be a block copolymer. The suitable percentage of the vinyl monomer component represented by the general formula (II) occupying in the copolymer is about 30~95% by weight.

If necessary, the binding agent may further be added with natural resins such as ester gum, softened rosin and the like, and natural resin-modified thermosetting resins such as natural resin-modified maleic resin, natural resin-modified phenol resin, natural resin-modified polyester resin, natural resin-modified pentaerythritol resin, epoxy resin and the like.

As a carrier liquid, there may be used, solely or in a combination of two kinds or more, paraffinic or isoparaffinic hydrocarbons (Isopar. H, Isopar. G, Isopar. L, Isopar. K, Naphtha No. 6, Solvesso 100 and the like produced by ESSO), ligroin, n-hexane, n-heptane, isooctane, n-octane, carbon tetrachloride, trichlorotrifluoroethane, cyclohexane and the like.

The thus obtained liquid developer of the present invention is excellent on the following points: (i) since the dye or pigment is dispersed to the extent of substantially primary particles, aggregation is hardly caused; (ii) since the primary dye or pigment particles are coated with a resin having a softening point of 50°~120° C., the colorant is well fixed on the transfer paper by thermally fixing a copy by means of a copying machine; and further (iii) since the toner particle diameter is smaller, and especially superior gradation reproducibility can be displayed and an improved color reproducibility can be displayed when used with an overhead projecter.

Now, preparation examples of colorants that comprises subjecting said dyes or pigments to flushing treatment with resins having a softening point of 50°~120° C. will be shown as follows.

PREPARATION EXAMPLE 1

A mixture of 1000 g of 10% toluene solution of polyethylene wax (C-7500 manufactured by Petrolite Co.) and 1000 g of 10% aqueous solution of the above listed pigment No. 4 was fully stirred in a flusher, and was kneaded at 150° C. for 4 hours. The resultant mixture was then dried in the presence of heat under a reduced pressure to remove water and solvent, and thereafter the dried mixture was pulverized, thus producing a yellow colorant.

PREPARATION EXAMPLE 2

The same procedure as in the above Preparation Example 1 was repeated, except that 1000 g of 10% toluene solution of polyethylene wax (210MP manufactured by Mitsui Sekiyu Kagaku) and 1000 g of 10% aqueous solution of the above mentioned pigment No. 2 were used. Thus, a bluish yellow colorant was produced.

PREPARATION EXAMPLE 3

The same procedure as in the above Preparation Example 1 was repeated, except that 1000 g of 10% toluene solution of wax (AC-polyethylene 430 manufactured by Allied Chemical Corp.) and 1000 g of 10% aqueous solution of the above mentioned pigment No. 1 were used. Thus, a reddish yellow colorant was produced.

COMPARATIVE PREPARATION EXAMPLE

The same procedure as in the above Preparation Example 1 was repeated, except that the polyethylene wax was replaced by "Hi-wax 405 MP" manufactured by Mitsui Sekiyu Kagaku) having a softening point of 126° C. Thus, a comparative yellow colorant was produced.

The above prepared colorants of the present invention and comparative colorant were used in the following Examples 1 to 3 and the Comparative Example to prepare the following respective liquid developers.

35 g of each of the above prepared colorants (colorants coated with resins) was mixed with 170 g of each of the binder resins and 800 g of each of the carrier liquids as listed in the following Table 1. The resultant each mixture was kneaded and dispersed in a ball mill for 40 hours to prepare a concentrated toner. 100 g of the concentrated toner thus prepared was diluted with 1 l of the same carrier liquid as used above, thus producing 4 kinds of liquid developers as listed below in Table 1.

TABLE 1

| No. | Colorant Coated with Resin | Carrier Liquid | Binder Resin |
|---|---|---|---|
| Example 1 | Preparation Example 1 | Isopar. H | LMA-GMA-MAA-2EHMA Copolymer |
| Example 2 | Preparation Example 2 | Isopar. L | LMA-GMA-AA Copolymer |
| Example 3 | Preparation Example 3 | Isopar. G | LMA-MAA-MMA-GMA Copolymer |
| Comparative Example | Comparative Preparation Example | Isopar. H | LMA-GMA-MAA Copolymer |

Note:
LMA: lauryl methacrylate
GMA: glycidyl methacrylate
MAA: methacrylic acid
2EHMA: 2-ethylhexyl methacrylate
MMA: methylmethacrylic acid
AA: acrylic acid Copies were made with the above listed liquid developers by a commericially available electrophotographic copier (DT-5700 manufactured by Ricoh Co.). Copy quality was evaluated and the results were shown in the following Table 2 wherein O represents good, Δ represents fair, and X represents no good.

TABLE 2

| | Image Density *1 | Fixativity *2 | Condition of Solid Image | Color Reproducibilty by OHP | Preservability *3 |
|---|---|---|---|---|---|
| Example 1 | 0.70 | | | | Δ |
| Example 2 | 0.74 | Δ~ | | | |
| Example 3 | 0.78 | | | | |
| Comparative Example | 0.62 | X~ | Δ~ | Δ~ | settling |

*1: measured by a Macbeth density meter.
*2: evaluated by time required until images are dried.
*3: evaluated by caking, settling and separation conditions after allowing a sample to stand for 7 days.

As can be seen from the above results, the liquid developers of the present invention are excellent on the points of gradation reproducibility, preservability, transparency, dryness (fixativity), and the like, and are improved especially on the point of color reproducibility when using an overhead projector.

What we claim is:

1. In a liquid developer for developing electrostatic latent images which comprises a toner comprising a colorant and a binding agent, as the main components, dispersed in an aliphatic hydrocarbon carrier liquid, the improvement which comprises: said colorant is prepared by flushing a yellow dye or pigment having the following general formula (I).

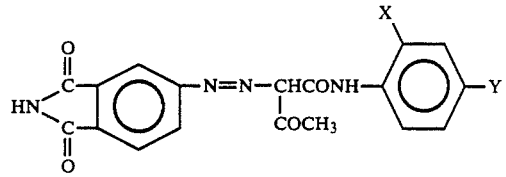

(I)

wherein X and Y represent —H, —$OCH_3$, —Cl, —$CH_3$, —$CH_2CH_3$, —$CH_2CH_2CH_3$, —$OCH_2CH_3$, —$CH_2CH_2CH_2CH_3$ or —$OCH_2CH_2CH_3$, with a resin which is insoluble in the carrier liquid and has a softening point of 50°-120° C.

2. The liquid developer as claimed in claim 1, wherein said dye or pigment is at least one selected from the group consisting of:

(1) Pigment Yellow 167 (C.I. No. 10737)

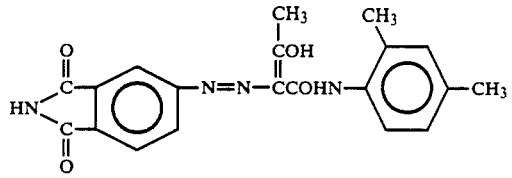

(2) N-[2-isoindoline-1,3-dione-5-ylazo)acetoacetyl-]aminobenzene

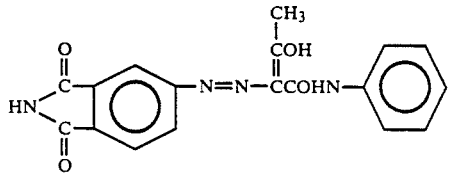

(3) N-[2-(isoindoline-1,3-dione-5-ylazo)acetoacetyl]1-amino-2,4-diethylbenzene

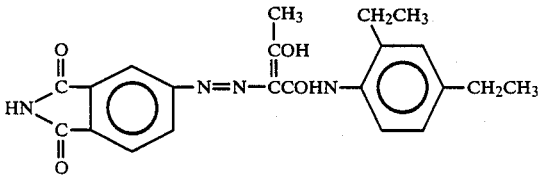

(4) N-[2-(isoindoline-1,3-dione-5-ylazo)acetoacetyl]1-amino-4-methylbenzene

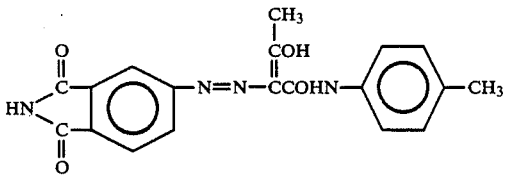

(5) N-[2-(isoindoline-1,3-dione-5-ylazo)acetoacetyl]1-amino-2,4-dimethoxybenzene

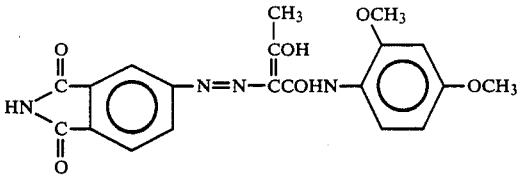

3. The liquid developer as claimed in claim 1, wherein said resin used in the flushing treatment is selected from the group consisting of polyethylene resin, polypropylene resin, vinylchloride resin, paraffin wax, bees wax and natural wax.

4. The liquid developer as claimed in claim 1, wherein said resin used in the flushing treatment is used in an amount of 0.1 to 6.0 parts by weight per 1 part by weight of said dye or pigment.

5. The liquid developer as claimed in claim 1, wherein said resin used in the flushing treatment is used in an amount of 0.1 to 0.6 part by weight per 1 part by weight of said dye or pigment.

6. The liquid developer as claimed in claim 1, wherein said binding agent is used in an amount of 1 to 10 parts by weight per 1 part by weight of said colorant.

7. The liquid developer as claimed in claim 1, wherein said binding agent is selected from the group consisting of alkyd resin, rosin-modified phenol formaldehyde resin, hydrogenated rosin-polyhydric alcohol ester, polyacryl or polymethacryl ester resin, styrene resin and chlorinated rubber.

8. The liquid developer as claimed in claim 7, wherein said binding agent is a homopolymer of an acrylic or methacrylic monomer represented by the following general formula (II),

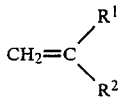

(II)

wherein $R^1$ represents hydrogen or methyl group, and $R^2$, and represents $-COOC_mH_{2m+1}$ or $OCOC_mH_{2m+1}$, and m is an integer of 6~20.

9. The liquid developer as claimed in claim 7, wherein said binding agent is a copolymer of an acrylic or methacrylic monomer of the general formula (II) with at least one monomer selected from the group consisting of acrylic acid, methacrylic acid, vinyl pyridine, ethylene glycol dimethacrylate, a monomer expressed by the following general formula (III),

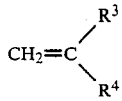

(III)

wherein $R^3$ represents hydrogen or methyl group, and $R^4$ represents $-COOC_mH_{2m+1}$ or $-OCOC_mH_{2m+1}$, and m is an integer of 15, and a monomer expressed by the following general formula (IV),

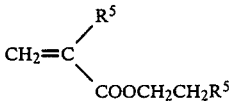

(IV)

wherein $R^5$ represents hydrogen or methyl group, and $R^6$ represents $-N(CH_3)_2$, $-N(C_2H_5)_2$ or $-OH$.

10. The liquid developer as claimed in claim 9, wherein said vinyl monomer component expressed by the general formula (II) occupies 30~95% by weight of said copolymer.

11. The liquid developer as claimed in claim 7, wherein said binding agent is further admixed with at least one selected from the group consisting of natural resins, natural resin-modified maleic resin, natural resin-modified phenol resin, natural resin-modified polyester resin, natural resin-modified pentaerythritol resin, and epoxy resin.

* * * * *

UNITED STATES PATENT AND TRADEMARK OFFICE

CERTIFICATE OF CORRECTION

PATENT NO. : 4,957,842

DATED : September 18, 1990

INVENTOR(S) : Toshiyuki FUKASE et al

It is certified that error appears in the above-identified patent and that said Letters Patent is hereby corrected as shown below:

Column 10, line 14; delete ", and".

line 15; change "$OCOC_mH_{2m+1}$," to

--- ——$OCOC_mH_{2m+1}$,---.

Signed and Sealed this

Twenty-first Day of April, 1992

*Attest:*

HARRY F. MANBECK, JR.

*Attesting Officer*

*Commissioner of Patents and Trademarks*